United States Patent [19]

Hosaka

[11] 4,332,863

[45] Jun. 1, 1982

[54] MAGNETIC RECORDING MEDIUM

[75] Inventor: Akihiko Hosaka, Tokyo, Japan

[73] Assignee: TDK Electronics Co., Ltd., Tokyo, Japan

[21] Appl. No.: 175,530

[22] Filed: Aug. 5, 1980

[30] Foreign Application Priority Data

Aug. 12, 1979 [JP] Japan ..... 54-0102667

[51] Int. Cl.[3] ..... H01F 10/10

[52] U.S. Cl. ..... 428/695; 427/127; 427/128; 427/129; 427/130; 428/900

[58] Field of Search ..... 427/127–132, 427/48; 428/900, 695

[56] References Cited

U.S. PATENT DOCUMENTS 3,790,407 2/1974 Merten ..... 427/130 X 3,900,593 8/1975 Herczog ..... 427/130 X

*Primary Examiner*—Bernard D. Pianalto

*Attorney, Agent, or Firm*—Oblon, Fisher, Spivak, McClelland & Maier

[57] ABSTRACT

A magnetic recording medium comprises a substrate coated with a binder and a magnetic powder obtained by forming an oleic acid layer on a surface of a metal or alloy magnetic powder obtained by a dry reduction.

2 Claims, 6 Drawing Figures

MAGNETIC RECORDING MEDIUM

BACKGROUND OF THE INVENTION

1. Field of the Invention

The present invention relates to a magnetic recording medium having high oxidation resistance.

2. Description of the Prior Arts

Home video tape recorders (VTR) have been developed and high quality audio cassette tapes have been commerciallized. High density of recorded signal for a magnetic recording medium has been required depending upon development of magnetic recording apparatuses.

Magnetic recording media which have been mainly used, are magnetic tapes and magnetic sheets prepared by forming a magnetic layer on a substrate such as a polyethyleneterephthalate film. Among the magnetic powders used for forming the magnetic layers, metal or alloy magnetic powders obtained by a wet reduction or a dry reduction have been known to use for the high density magnetic recording medium. These metal or alloy magnetic powders, however, have disadvantages that rust is easily formed by an oxidation to cause serious deterioration of magnetic characteristics in aging whereby they have not been practically used even though the metal or alloy magnetic powders have been expected as suitable magnetic powders for the high density magnetic recording medium.

SUMMARY OF THE INVENTION

It is an object of the present invention to overcome the above-mentioned disadvantages and to provide a high density magnetic recording medium which has high oxidation resistance and remarkably less deterioration in aging and high reliability.

The foregoing and other objects of the present invention have been attained by providing a magnetic recording medium which comprises a substrate coated with a binder and a magnetic powder obtained by forming an oleic acid layer on a surface of a metal or alloy magnetic powder obtained by a dry reduction.

DETAILED DESCRIPTION OF THE PREFERRED EMBODIMENTS

Figure 1:
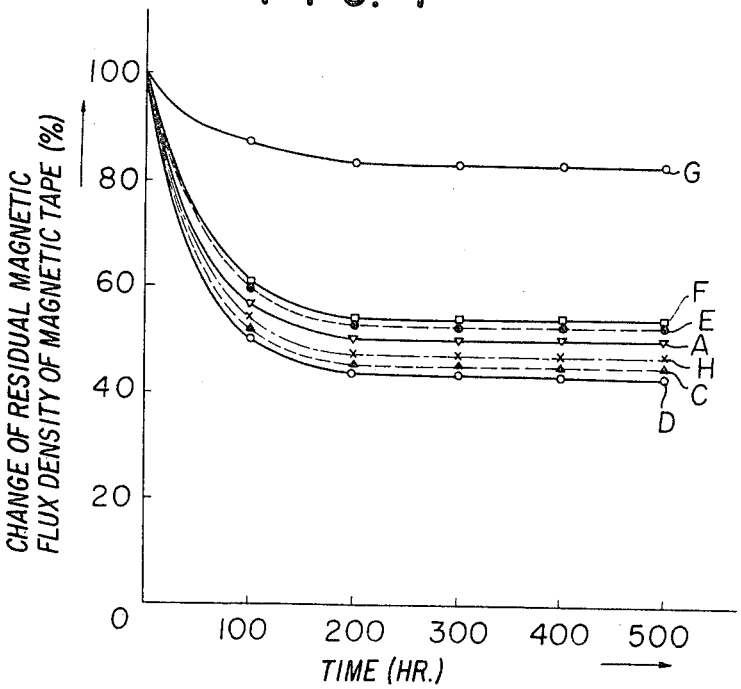
FIGS. 1 and 2 are graphs showing changes of residual magnetic flux densities of magnetic tapes prepared by using magnetic powders obtained by a wet reduction in the relation of time for aging (oxidation resistance)

The metal or alloy magnetic powders are prepared by a dry reduction. An acicular iron oxide powder such as $\alpha$-$Fe_2O_3$ is heat-treated in nitrogen atmosphere at suitable temperature such as about 400° C. and then, is reduced in hydrogen gas. The dry reduction is preferably carried out in a hydrogen gas flow at suitable temperrature for the reduction. The product obtained by the dry reduction is usually recovered from an inert medium such as hydrocarbons. The conditions for thwe dry reduction can be selected from the known conditions.

In the formation of the oleic acid layer on the surface of the magnetic powder, oleic acid is dissolved in an inert medium such as hydrocarbons and the product obtained by the dry reduction is dipped into the inert medium solution of oleic acid and the dispersion is filtered and dried to obtain the metal or alloy magnetic powder having oleic acid layer on the surface. A concentration of oleic acid in the solution is usually in a range of 0.2 to 15 wt.% preferably 0.5 to 10 wt.% especially higher than 1.0 wt.%. Before the treatment with the solution of oleic acid, the product is preferably kept in an inert medium so as to prevent the contact with an oxidation atmosphere such as air.

The magnetic recording medium can be prepared by the conventional process except using the oleic acid coated metal or alloy magnetic powder. The detail of the preparations and structures of various magnetic recording media are not recited.

The present invention will be illustrated by certain examples and references which are provided for purposes of illustration only and are not intended to be limiting the present invention.

EXAMPLE 1

(A) Preparation of Magnetic Powder

In a remelt, 100 g. of acicular iron oxide $\alpha$-$Fe_2O_3$ obtained by a dry reduction was charged and was heat-treated in nitrogen gas at 400° C. and then was reduced in hydrogen gas passing at a flow rate of 15 l/min. for 5 hr. and then, dipped into toluene and dried. The resulting magnetic powder was charged and dispersed into 500 g. of a toluene solution containing 2 wt.% of oleic acid by thoroughly stirring it and the product was filtered and dried to obtain a magnetic powder.

(B) Preparation of Magnetic Tape

The following magnetic compositions a thermosettable type Composition 1 and a thermoplastic type Composition 2 as typical compositions for magnetic tapes were prepared by using the resulting magnetic powder.

| | |
|---|---|
| Formula of magnetic Composition 1: | |
| Magnetic powder | 2,000 wt. parts |
| Polyurethane resin | 300 wt. parts |
| Nitrocellulose | 200 wt. parts |
| Lubricant | 25 wt. parts |
| Methyl ethyl ketone | 2,000 wt. parts |
| Methyl isobutyl ketone | 1,000 wt. parts |
| Toluene | 1,000 wt. parts |
| Formula of magnetic Composition 2: | |
| Magnetic powder | 2,000 wt. parts |
| Vinyl chloride-vinyl acetate copolymer (VAGH manufactured by UCC) | 400 wt. parts |
| Acrylonitrile-butadiene copolymer (Hica 1432J manufactured by Nippon Zeon K.K.) | 100 wt. parts |
| Lubricant | 25 wt. parts |
| Methyl ethyl ketone | 2,000 wt. parts |
| Methyl isobutyl ketone | 800 wt. parts |
| Toluene | 800 wt. parts |

In the Composition 1, the components were thoroughly mixed and dispersed in a disperser and then, 12 wt. parts of polyisocyanate (Desmodule L manufactured by Bayer A.G.) as a crosslinking agent was added. The mixture was homogeneously mixed to prepare the magnetic composition. The magnetic composition was coated in a thickness of 5μ (in dry) on a polyethyleneterephthalate film having a thickness of 15μ. The surface of the coated layer was treated by a super-calender treatment and then, heated at 60° C. for 48 hr. to cure it. The coated film was cut in a desired width to prepare a magnetic tape.

In the Composition 2, the components were mixed and dispersed to prepare the magnetic composition. The magnetic composition was coated in a thickness of 5μ (in dry) on a polyethyleneterephthalate film having a thickness of 15μ. The surface of the coated layer was treated by a super-calender treatment. The coated film was cut in a desired width to prepare a magnetic tape.

The magnetic tape prepared by using the Composition 1 is referred as M and the magnetic tape prepared by using the Composition 2 is referrred as m.

EXAMPLE 2

(A) Preparation of Magnetic Powder

Each magnetic powder obtained by the dry reduction of Example 1 was admixed with 500 g. of each toluene solution containing oleic acid at a ratio of 0%, 0.5%, 1.0%, 1.5%, 2.0%, 4.0% or 6.0% to disperse the magnetic powder. The magnetic powder was filtered and dried to obtain the treated magnetic powder. The samples of the resulting magnetic powders are referred as O, P, Q, R, S, T and U.

(B) Preparation of Magnetic Tape

Seven type magnetic tapes were prepared by using each magnetic composition having the formula of the magnetic Composition 1 except using each of the magnetic powders O, P, Q, R, S, T and U. The magnetic tapes corresponding to the magnetic powder O, P, Q, R, S, T and U are referred to o, p, q, r, s, t and u.

REFERENCE 1

(A) Preparation of Magnetic Powder

The magnetic powder was prepared by the wet reduction.

5 l. of a solution containing ferrous sulfate at a ratio of 0.7 mol./l. and cobalt sulfate at a ratio of 0.3 mol./l. was admixed with 5 l. of a solution containing 1.0 mol. of sodium borohydride. The reaction of the mixture was carried out in a magnetic field of 1200 gauss.

The resulting magnetic powder was washed with water and treated in isopropyl alcohol and charged in toluene and dried.

(B) Preparation of Magnetic Tape

Two type magnetic tapes were prepared by using each magnetic composition having the formula of the magnetic Composition 1 or 2 except using the resulting magnetic powder. The magnetic tape prepared by using the magnetic Composition 1 is referred as magnetic tape A and the magnetic tape prepared by using the magnetic Composition 2 is referred as magnetic tape a.

REFERENCE 2

(A) Preparation of Magnetic Powder

The magnetic powder was prepared by the dry reduction method.

In a remelt, as the process of Example 1, 100 g. of acicular iron oxide $\alpha$-$Fe_2O_3$ was charged and heat-treated in nitrogen gas at 400° C. for 1 hr. and then, reduced in hydrogen gas passing at a flow rate of 15 l./min. for 5 hr. and dipped in toluene and dried.

(B) Preparation of Magnetic Tape

Two type magnetic tapes were prepared by using each magnetic composition having the formula of the magnetic Composition 1 or 2 except using the resulting magnetic powder. The magnetic tape prepared by using the magnetic Composition 1 is referred as magnetic tape B and the magnetic tape prepared by using the magnetic Composition 2 is referred as magnetic tape c.

REFERENCE 3

(A) Preparation of Magnetic Powder

Each magnetic powder obtained by the wet reduction of Reference 1 was admixed with 500 g. of each toluene solution containing 2 wt.% of stearic acid, palmitic acid, lauric acid, capric acid, oleic acid or linolenic acid. Each mixture was thoroughly mixed and filtered and dried to obtain six type magnetic powders.

(B) Preparation of Magnetic Tape

Each magnetic tape was prepared by using each magnetic composition having the formula of the magnetic Composition 1 or 2 except using the resulting magnetic powder. The magnetic tapes prepared by using the magnetic Composition 1 are referred as magnetic tapes C, D, E, F, G or H. The magnetic tapes prepared by using the magnetic Composition 2 are referred as magnetic tapes c, d, e, f, g, or h.

REFERENCE 4

(A) Preparation of Magnetic Powder

Each magnetic powder obtained by the dry reduction of Example 1 or 2 was admixed with 500 g. of each toluene solution containing 2 wt.% of stearic acid, palmitic acid, lauric acid, capric acid, or linolenic acid. Each mixture was thoroughly mixed and filtered and dried to obtain five type magnetic powders.

(B) Preparation of Magnetic Tape

Each magnetic tape was prepared by using each magnetic composition having the formula of the magnetic Composition 1 or 2 except using the resulting magnetic powder. The magnetic tapes prepared by using the magnetic Composition 1 are referred as magnetic tapes I, J, K, L or N. The magnetic tapes prepared by using the magnetic Composition 2 are referred as magnetic tapes i, j, k, l or n.

The magnetic tapes and the magnetic powders prepared in Examples 1 and 2 and References 1 to 4 were kept in an atmosphere having a relative humidity of 90% at 60° C. The changes of the residual magnetic flux density Br of the magnetic tape and the changes of the residual magnetic flux density $\sigma_r$ of the magnetic powder (Example 2) were measured. The results are shown in FIGS. 1 to 6.

Figure 2:
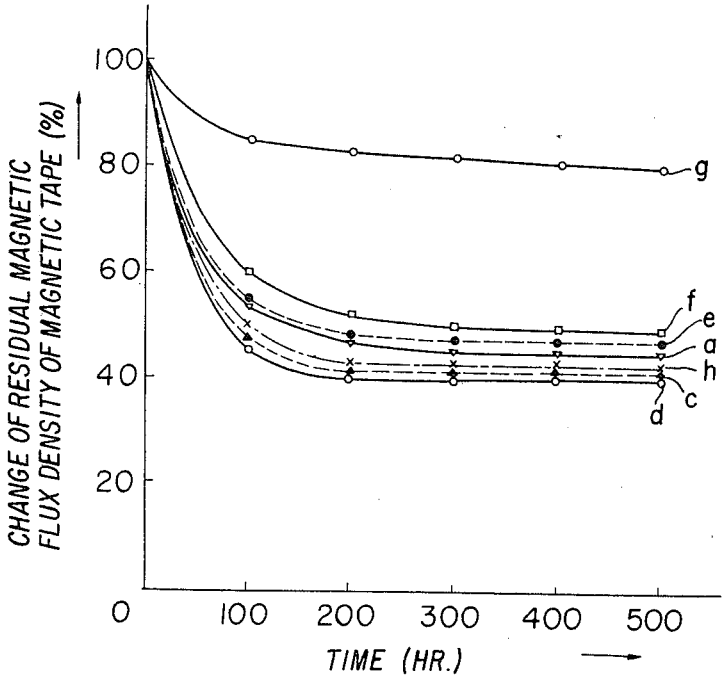

FIGS. 1 and 2, show the changes of the residual magnetic flux density Br of the magnetic tapes of References 1 and 3 which were prepared by using the magnetic powders obtained by the wet reduction in the relation of time for aging (oxidation resistance).

Figure 3:
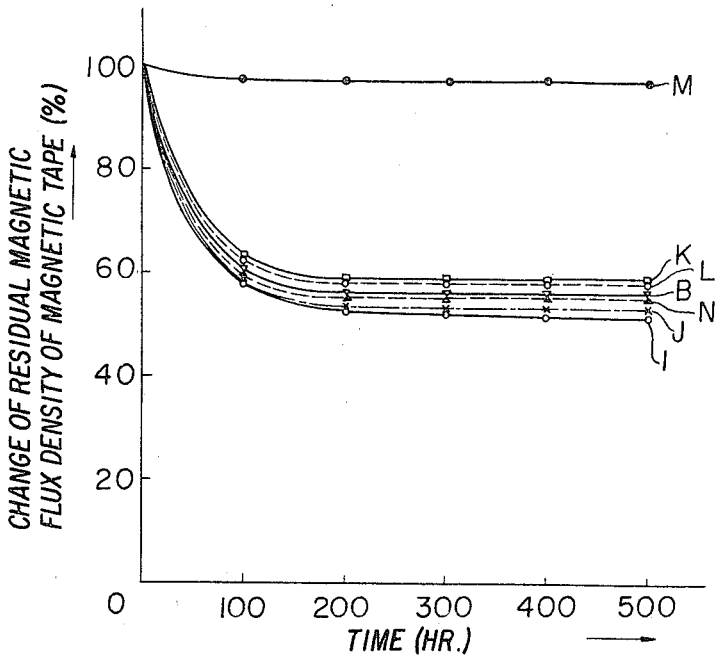
FIGS. 3 and 4 are graphs showing changes of residual magnetic flux densities of magnetic tapes prepared by using magnetic powders obtained by a dry reduction in the relation of time for aging (oxidation resistance)
Figure 4:
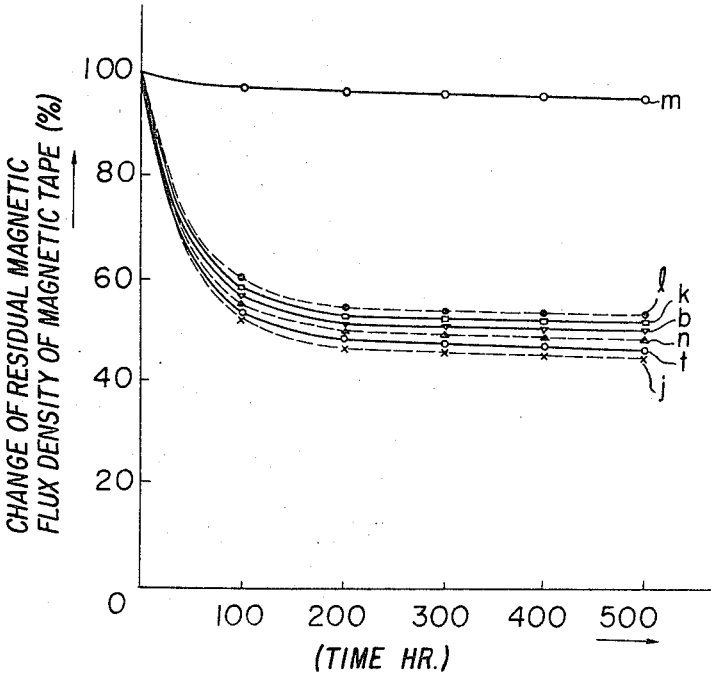

FIGS. 3 and 4 show the changes of the residual magnetic flux density Br of the magnetic tapes of Example 1 and References 2 and 4 which were prepared by using the magnetic powders obtained by the dry reduction in the relation of time for aging (oxidation resistance).

Figure 5:
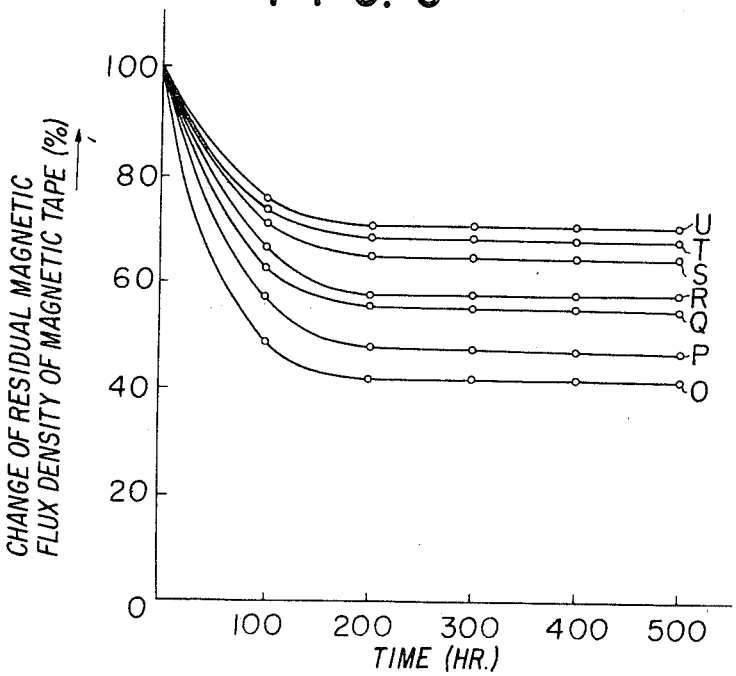
FIG. 5 is a graph showing changes of residual magnetic flux densitites of magnetic powders of the present invention in the relation of time for aging (oxidation resistance)

FIG. 5 shows the changes of the residual magnetic flux density $\sigma_r$ of the magnetic powder obtained in Example 2 in the relation of time for aging (oxidation resistance).

Figure 6:
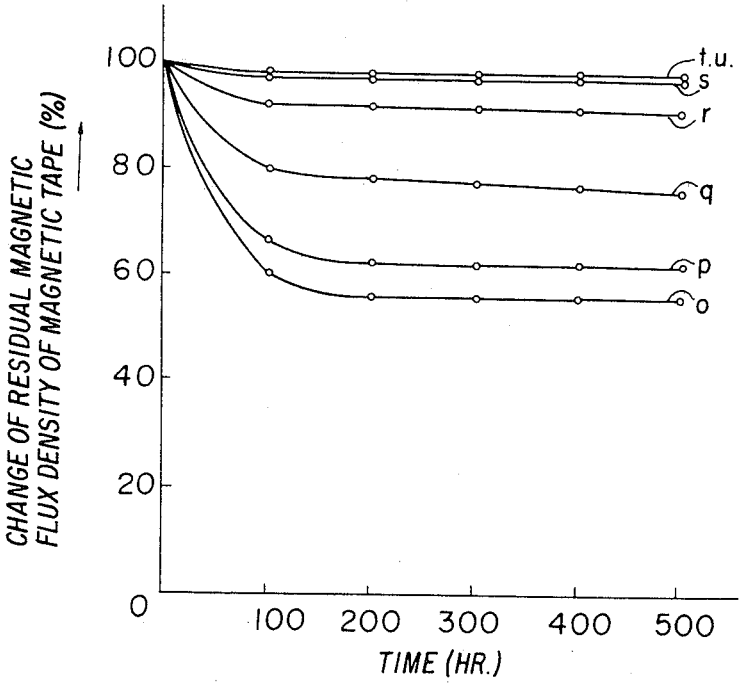
FIG. 6 is a graph showing changes of residual magnetic flux densities of magnetic tapes of the present invention in the relation of time for aging (oxidation resistance).

FIG. 6 shows the changes of the residual magnetic flux density Br of the magnetic tape obtained in Example 2 in the relation of time for aging (oxidation resistance).

In the graphs the symbols for the curves respectively designate the magnetic powders and the magnetic tapes prepared in the examples and the references.

As it is clear from FIGS. 3 and 4, the magnetic tapes M and m of the present invention prepared by forming the oleic acid layer on the surface of the magnetic powder obtained by the dry reduction and coating it with the binders had excellent oxidation resistance in the aging as only 3 to 5% of reduction of the residual magnetic flux density Br after aging for 500 hr.

The magnetic powder itself obtained by the dry reduction had not satisfactory oxidation resistance as shown in FIG. 5.

However, when the magnetic powder is coated with oleic acid and the magnetic composition is prepared by using it with the binders and the magnetic tape is prepared by using the composition, the formation of oxidized layer on the surface of the magnetic powder is promoted by oleic acid and the wettability on the surface of the magnetic powder is improved by oleic acid as a performance of a surfactant to improve the dispersibility whereby the binders are uniformly and firmly bond on the surface of the magnetic powder.

As the effect of the dry reduction in hydrogen gas at high temperature, the surface of the magnetic powder is improved to decrease the adverse effect of humidity. As a result, the oxidation resistance is remarkably improved when the treated magnetic powder is used for the magnetic tape.

On the other hand, when other aliphatic acids than oleic acid are used, the above-mentioned effect is not attained whereby the oxidation resistance required for the practical use is not satisfactorily given as shown in FIGS. 3 and 4.

The wet reduction is to directly react the metal or alloy magnetic powder in an aqueous solution. Therefore, the improved modification of the surface of the magnetic powder as the dry reduction, is not found whereby the hygroscopic property is found.

As shown in FIGS. 1 and 2, the moisture proof effects of the references are inferior to those of FIGS. 3 and 4. The oxidation resistance required for the practical use is not satisfactory.

As shown in FIGS. 5 and 6, the effect for improving the oxidation resistance is remarkably high and stable by incorporating olefic acid at a ratio of greater than 1.5 wt.%.

In the physical characteristics of the magnetic tape, when a large amount of oleic acid is incorporated, even though the oxidation resistance is improved, oleic acid is migrated on the surface of the magnetic layer. Therefore, it is preferable to incorporate oleic acid at a ratio of about 1.5 to 4.0 wt.%.

As described above, the magnetic recording medium of the present invention is prepared by forming oleic acid layer on the surface of the metal or alloy magnetic powder obtained by the dry reduction and coating the product with binders on a substrate thereby providing a magnetic recording medium for high density recording which has remarkably high oxidation resistance and stability and remarkably small deterioration in aging and high reliability.

What is claimed is:

1. A magnetic recording medium comprising a substrate coated with a magnetic composition, said composition having been obtained by (1) dry reducing a metal oxide powder in a hydrogen atmosphere, (2) maintaining the resulting magnetic powder in an inert medium to prevent contact with an oxidizing atmosphere, (3) dispersing the magnetic powder in an inert medium solution of oleic acid to form an oleic acid layer on the surface of the powder, (4) drying the coated magnetic powder, and (5) incorporating the dried, coated magnetic powder into the magnetic composition.

2. The magnetic recording medium of claim 1 wherein the metal oxide powder is subjected to a heat-treatment in an inert gas prior to the dry reduction in a hydrogen atmosphere.

* * * * *

UNITED STATES PATENT AND TRADEMARK OFFICE

CERTIFICATE OF CORRECTION

PATENT NO. : 4,332,863

DATED : June 1, 1982

INVENTOR(S) : AKIHIKO HOSAKA

It is certified that error appears in the above—identified patent and that said Letters Patent is hereby corrected as shown below:

Please correct as follows:

[30] -- Foreign Application Priority Data

Aug. 12, 1979 [JP] Japan ..... 54-102667 --

Signed and Sealed this

*Tenth* Day of *August 1982*

[SEAL]

*Attest:*

GERALD J. MOSSINGHOFF

*Attesting Officer* *Commissioner of Patents and Trademarks*